US011244636B2

(12) United States Patent
Shi et al.

(10) Patent No.: US 11,244,636 B2
(45) Date of Patent: Feb. 8, 2022

(54) DISPLAY DEVICE COMPRISING BACKLIGHT UNIT WITH BACKLIGHT BLOCKS IN ROWS DRIVEN BY LOCAL DIMMING METHOD

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Tiankuo Shi, Beijing (CN); Lingyun Shi, Beijing (CN); Zhihua Ji, Beijing (CN); Xin Duan, Beijing (CN); Wei Sun, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/647,568

(22) PCT Filed: Feb. 27, 2019

(86) PCT No.: PCT/CN2019/076344
§ 371 (c)(1),
(2) Date: Mar. 16, 2020

(87) PCT Pub. No.: WO2020/172822
PCT Pub. Date: Sep. 3, 2020

(65) Prior Publication Data

US 2021/0225298 A1 Jul. 22, 2021

(51) Int. Cl.

| | |
|---|---|
| ***G09G 3/34*** | (2006.01) |
| ***G09G 3/36*** | (2006.01) |
| ***G09G 5/10*** | (2006.01) |

(52) U.S. Cl.
CPC ..... *G09G 3/3426* (2013.01); *G09G 3/3607* (2013.01); *G09G 3/3688* (2013.01); (Continued)

(58) Field of Classification Search
CPC ..... G09G 3/36; G09G 3/3607; G09G 3/3611; G09G 3/3648; G09G 3/3677; (Continued)

(56) References Cited

U.S. PATENT DOCUMENTS 10,872,558 B2 * 12/2020 Ji ..... G09G 3/3426
10,923,046 B2 * 2/2021 Sun ..... G09G 3/2096
(Continued)

FOREIGN PATENT DOCUMENTS

CN 102446494 5/2012

*Primary Examiner* — Alexander Eisen
*Assistant Examiner* — Nelson Lam
(74) *Attorney, Agent, or Firm* — Leason Ellis LLP

(57) ABSTRACT

An image display processing method for a display device, an image display processing device, a display device, and a storage medium are provided. The display device includes a backlight unit, the backlight unit includes a plurality of backlight blocks and is driven by a local dimming method. The image display processing method includes: obtaining backlight values of backlight blocks in N rows according to display data, which are transmitted, of pixels corresponding to the backlight blocks in the N rows in a current frame of image; based on the display data of the pixels corresponding to the backlight blocks in the N rows and the backlight values, which are obtained, of the backlight blocks in the N rows, obtaining compensated display data of the pixels corresponding to the backlight blocks in the N rows in the current frame of image.

18 Claims, 10 Drawing Sheets

(52) U.S. Cl.
CPC ..... *G09G 5/10* (2013.01); *G09G 2320/0242* (2013.01); *G09G 2320/066* (2013.01)

(58) Field of Classification Search
CPC .. G09G 3/3681; G09G 3/3688; G09G 3/3692; G09G 2320/0242; G09G 2320/062; G09G 2320/0613; G09G 2320/0626; G09G 2320/066; G09G 2320/0666
USPC ..... 345/87–104
See application file for complete search history.

(56) References Cited

U.S. PATENT DOCUMENTS 10,930,225 B2 * 2/2021 Ji ..... G09G 3/36
2010/0020005 A1 * 1/2010 Jung ..... G09G 3/3426 345/102
2011/0141166 A1 * 6/2011 Ahn ..... G09G 3/3426 345/691
2012/0086713 A1 4/2012 Cho et al.
2012/0162276 A1 * 6/2012 Jang ..... G09G 3/3426 345/690
2013/0215161 A1 * 8/2013 Cho ..... G09G 3/3426 345/694
2014/0340429 A1 * 11/2014 Inamura ..... G09G 5/006 345/690
2016/0203774 A1 * 7/2016 Ahn ..... G09G 3/3426 345/102
2020/0066214 A1 * 2/2020 Lin ..... G09G 3/3406
2020/0279534 A1 * 9/2020 Ji ..... G09G 3/3648
2021/0134236 A1 * 5/2021 Shiomi ..... G09G 3/3426
2021/0158766 A1 * 5/2021 Zhao ..... G09G 3/36
2021/0225303 A1 * 7/2021 Shi ..... G09G 3/3406
2021/0233478 A1 * 7/2021 Sun ..... G09G 3/36

* cited by examiner

DISPLAY DEVICE COMPRISING BACKLIGHT UNIT WITH BACKLIGHT BLOCKS IN ROWS DRIVEN BY LOCAL DIMMING METHOD

CROSS-REFERENCE TO RELATED PATENT APPLICATIONS

This application is a U.S. National Stage Application under 35 U.S.C. § 371 of International Patent Application No. PCT/CN2019/076344, filed Feb. 27, 2019, which is incorporated by reference in its entirety.

TECHNICAL FIELD

The embodiments of the present disclosure relate to an image display processing method, an image display processing device, a display device, and a storage medium.

BACKGROUND

With continuous improvement of electronic technology level, Virtual Reality (VR) technology or Augmented Reality (AR) technology is as a high and new technology, and has been increasingly applied in daily life, such as in games, entertainment, and the like. Virtual Reality technology is also referred to as vision technology or artificial environment.

An existing virtual reality system simulates a virtual three-dimensional world mainly through a high-performance computing system including a central processing unit, and provides a user with a sensory experience of vision, hearing, etc. through a head-mounted device, so that the user can feel as if he is present on the scene, and in addition, human-computer interaction can be carried out.

SUMMARY

At least one embodiment of the present disclosure provides an image display processing method for a display device, the display device comprises a backlight unit, the backlight unit comprises backlight blocks in L rows and is driven by a local dimming method, and the image display processing method comprises: obtaining backlight values of backlight blocks in N rows according to display data of pixels corresponding to the backlight blocks in the N rows in a current frame of image; based on the display data of the pixels corresponding to the backlight blocks in the N rows and the backlight values, which are obtained, of the backlight blocks in the N rows, obtaining compensated display data of the pixels corresponding to the backlight blocks in the N rows in the current frame of image; and N is an integer, and N is greater than or equal to 1 and is less than L.

For example, in the image display processing method provided by some embodiments of the present disclosure, the display device further comprises a display panel, the backlight unit is on a non-display side of the display panel, and the image display processing method further comprises: inputting the backlight values of the backlight blocks in the N rows to the backlight unit; and inputting the compensated display data of the pixels corresponding to the backlight blocks in the N rows in the current frame of image to the display panel of the display device to perform a display operation on the display panel.

For example, the image display processing method provided by some embodiments of the present disclosure further comprises: before obtaining the backlight values of the backlight blocks in the N rows, writing the display data of the pixels corresponding to the backlight blocks in the N rows in the current frame of image into a storage unit to obtain two copies of the display data; one copy of the display data is used to obtain the backlight values of the backlight blocks in the N rows, and another copy of the display data is stored and used to obtain the compensation display data of the pixels corresponding to the backlight blocks in the N rows in the current frame of image.

For example, the image display processing method provided by some embodiments of the present disclosure further comprises: by the storage unit, at least storing the display data of the pixels corresponding to the backlight blocks in the N rows.

For example, in the image display processing method provided by some embodiments of the present disclosure, obtaining the compensated display data of the pixels corresponding to the backlight blocks in the N rows in the current frame of image comprises: based on the backlight values of the backlight blocks in the N rows and backlight values of backlight blocks in previous at least one row adjacent to the backlight blocks in the N rows and in next at least one row adjacent to the backlight blocks in the N rows, fitting to obtain a backlight diffusion model; obtaining actual backlight values of the pixels corresponding to the backlight blocks in the N rows based on the backlight diffusion model; and compensating the display data of the pixels corresponding to the backlight blocks in the N rows in the current frame of image according to the actual backlight values to obtain the compensated display data of the pixels.

For example, in the image display processing method provided by some embodiments of the present disclosure, obtaining the backlight values of the backlight blocks in the N rows according to the display data of the pixels corresponding to the backlight blocks in the N rows in the current frame of image, comprises: counting gray values of display data of pixels corresponding to respective backlight blocks in each row of the N rows, respectively; and obtaining backlight values of the respective backlight blocks based on the gray values of the display data of the pixels corresponding to the respective backlight blocks.

For example, in the image display processing method provided by some embodiments of the present disclosure, the gray values of the display data of the pixels corresponding to the respective backlight blocks in each row of the N rows are counted through a histogram, respectively.

For example, in the image display processing method provided by some embodiments of the present disclosure, a gray value at a position in a range of 80% to 90% of the gray values, which are counted and sorted in an order from small to large, of the display data of the pixels corresponding to each backlight block is set as the backlight value of the corresponding backlight block, or an average value of the gray values of the display data of the pixels corresponding to each backlight blocks is set as the backlight values of the corresponding backlight block.

For example, in the image display processing method provided by some embodiments of the present disclosure, the compensated display data of the pixels are obtained according to a following formula:

$$Vc = V0 * (BL_M / BL_P)$$

where Vc represents compensated display data of a pixel among all pixels corresponding to the backlight blocks in the N rows, V0 represents display data of the pixel before the pixel is compensated, BL_M represents a backlight value corresponding to the pixel at a highest gray level, and BL_P represents an actual backlight value corresponding to the pixel.

For example, the image display processing method provided by some embodiments of the present disclosure further comprises: taking every N rows as a period, sequentially obtaining compensated display data of all pixels of the current frame of image.

For example, in the image display processing method provided by some embodiments of the present disclosure, each of the backlight blocks comprises a mini light-emitting diode.

For example, in the image display processing method provided by some embodiments of the present disclosure, N is equal to 1.

At least one embodiment of the present disclosure further provides an image display processing device, and the image display processing device comprises: a storage unit, configured to store display data of pixels corresponding to backlight blocks in N rows in a current frame of image; a local dimming unit, configured to receive the display data, which is transmitted, of the pixels corresponding to the backlight blocks in the N rows in the current frame of image; obtain backlight values of the backlight blocks in the N rows according to the display data, which is transmitted, of the pixels corresponding to the backlight blocks in the N rows in the current frame of image; and based on the display data, which is stored, of the pixels corresponding to the backlight blocks in the N rows and the backlight values, which are obtained, of the backlight blocks in the N rows, obtain compensated display data of the pixels corresponding to the backlight blocks in the N rows in the current frame of image; the current frame of image corresponds to backlight blocks in L rows, N is an integer, and N is greater than or equal to 1 and is less than L.

For example, in the image display processing device provided by some embodiments of the present disclosure, the local dimming unit comprises a backlight value obtaining unit and a display data obtaining unit; and the backlight value obtaining unit is configured to obtain the backlight values of the backlight blocks in the N rows according to the display data, which is transmitted, of the pixels corresponding to the backlight blocks in the N rows; the display data obtaining unit is configured to, based on the display data, which is stored, of the pixels corresponding to the backlight blocks in the N rows and the backlight values, which are obtained, of the backlight blocks in the N rows, obtain the compensated display data of the pixels corresponding to the backlight blocks in the N rows in the current frame of image.

For example, in the image display processing device provided by some embodiments of the present disclosure, the storage unit is configured to at least store the display data of the pixels corresponding to the backlight blocks in the N rows.

At least one embodiment of the present disclosure further provides an image display processing device, and the image display processing device comprises: a processor; and a memory, storing one or more computer program modules, the one or more computer program modules are configured to be executed by the processor, and the one or more computer program modules comprise instructions for performing the image display processing method according to any one of the above embodiments of the present disclosure.

At least one embodiment of the present disclosure further provides a display device, and the display device comprises: a display panel, a backlight unit, a storage unit, and a local dimming unit; the backlight unit comprises backlight blocks in L rows and is driven by a local dimming method; the storage unit is configured to store display data of pixels corresponding to backlight blocks in N rows in a current frame of image; the local dimming unit is configured to receive the display data, which is transmitted, of the pixels corresponding to the backlight blocks in the N rows in the current frame of image; obtain backlight values of the backlight blocks in the N rows according to the display data, which is transmitted, of the pixels corresponding to the backlight blocks in the N rows in the current frame of image; and based on the display data, which is stored, of the pixels corresponding to the backlight blocks in the N rows and the backlight values, which are obtained, of the backlight blocks in the N rows, obtain compensated display data of the pixels corresponding to the backlight blocks in the N rows in the current frame of image; and N is an integer, is greater than or equal to 1, and is less than L.

At least one embodiment of the present disclosure further provides a storage medium, and the storage medium non-temporarily stores computer-readable instructions, in the case where the computer-readable instructions, which are stored non-temporarily, are executed by a computer, the image display processing method according to any one of the above embodiments of the present disclosure is performed.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

Figure 1A:
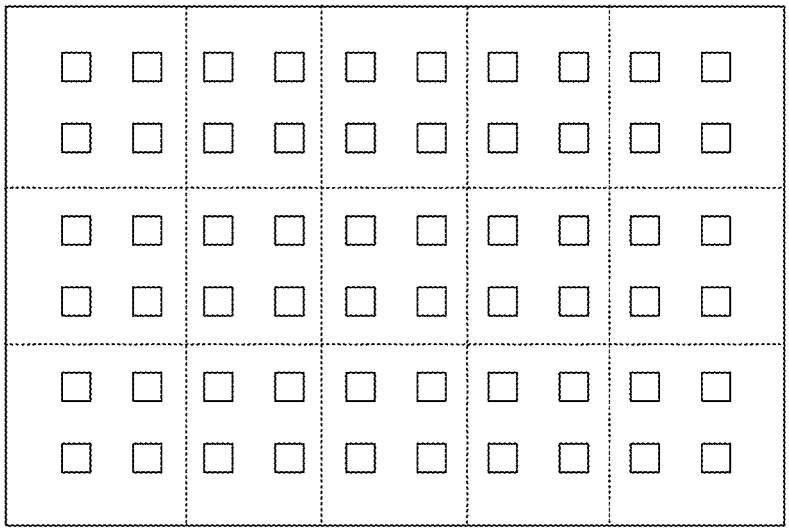
FIG. 1A is a schematic diagram of a backlight unit.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

The present disclosure is described below with reference to some specific embodiments. In order to enable the following description of the embodiments of the present disclosure clear and concise, the present disclosure omits detailed description of known functions and known components. In the case where any component according to an embodiment of the present disclosure appears in at least one drawing, the component is denoted by the same or similar reference numerals in each drawing.

A liquid crystal display panel includes a liquid crystal panel and a backlight unit. Generally, the liquid crystal panel includes an array substrate and an opposite substrate (for example, a color filter substrate), which are disposed opposite to each other to form a liquid crystal cell, and a liquid crystal layer is filled between the array substrate and the opposite substrate in the liquid crystal cell. A first polarizer is on the array substrate, and a second polarizer is on the opposite substrate, and a polarization direction of the first polarizer is perpendicular to a polarization direction of the second polarizer, for example. The backlight unit is on a non-display side of the liquid crystal panel for providing a planar light source for the liquid crystal panel. Liquid crystal molecules of the liquid crystal layer are twisted under an action of a driving electric field formed between a pixel electrode on the array substrate and a common electrode on the array substrate or a common electrode on the opposite substrate, thereby controlling a polarization direction of light passing through the liquid crystal layer, and transmittance of the light is controlled under the cooperation of the first polarizer and the second polarizer, thereby achieving grayscale display.

The backlight unit may be a direct-lit backlight unit or a side-lit backlight unit. A direct-lit backlight unit includes a plurality of point light sources (for example, light-emitting diodes (LEDs)) arranged side by side and a diffusion plate. Light emitted by the point light sources is homogenized by the diffusion plate, and then incident on the liquid crystal panel for display.

At present, high-resolution liquid crystal display panels are also gradually applied to VR devices. During use of a VR device, because the human eyes are relatively close to a display screen, the human eyes are easier to perceive a display effect of a display image, and therefore, the requirements for a resolution and a display quality of the display panel are also getting higher and higher.

For example, for the liquid crystal display panel, the direct-lit backlight unit can be controlled by local dimming (LD) technology, so as to improve the display quality of the display panel. The local dimming technology can not only reduce power consumption of the display panel, but also achieve dynamic dimming of a backlight area, thus greatly improving the contrast of a display image and improving the display quality of the display panel.

The local dimming technology can divide an entire backlight unit into a plurality of backlight blocks which can be driven individually, and each of the plurality of backlight blocks includes one or more LEDs. According to gray scales that need to be displayed in different parts of the display screen, driving currents of the LEDs of the backlight blocks corresponding to these parts are automatically adjusted, so that brightness of each block in the backlight unit is separately adjusted, thereby improving the contrast of the display screen. The local dimming technology is generally only applicable to the direct-lit backlight unit, and a plurality of LEDs as the light sources are evenly distributed throughout an entire backplane, for example.

For example, in an exemplary direct-lit backlight unit, a schematic diagram of dividing regions of the LED light sources in the entire backplane is shown in FIG. 1A. A small square as shown in FIG. 1A represents an LED unit, and a plurality of regions separated by broken lines represent a plurality of backlight blocks. Each of the plurality of backlight blocks includes one or more LED units and can be controlled independently of other backlight blocks. For example, the LEDs in each of the plurality of backlight blocks are linked, for example, connected in series, that is, currents passing through the LEDs located in the same backlight block are consistent, so that the luminance brightness of the LEDs located in the same backlight block is substantially the same.

Figure 1B:
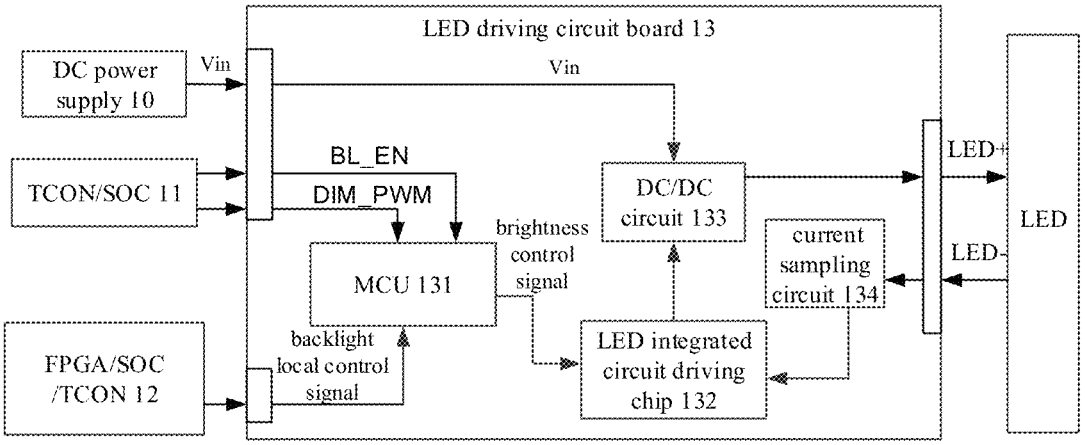
FIG. 1B is a schematic diagram of an exemplary system for performing local dimming on the backlight unit as shown in FIG. 1A.

FIG. 1B is a schematic diagram of an exemplary system for performing local dimming processing on the backlight unit as shown in FIG. 1A. For example, in some examples, the system is implemented by a hardware circuitry. As shown in FIG. 1B, the system includes, for example, a DC power supply 10, a TCON (Timer Control Register)/SOC (System On Chip) 11, an FPGA (Field-Programmable Gate Array)/SOC/TCON 12, and an LED driving circuit board 13 for driving the LEDs to emit light. As shown in FIG. 1B, the LED driving circuit board 13 includes a micro-chip unit (MCU) 131, an LED integrated circuit driving chip 132, a DC/DC circuit 133, and a current sampling circuit 134. The LED driving circuit board 13 is configured to process each frame of image signal to obtain processed backlight brightness data of respective backlight blocks, and generate driving currents used for various backlight blocks based on the backlight brightness data. The driving currents are output to the corresponding backlight blocks to drive the LEDs in the corresponding backlight blocks to emit light by currents.

The MCU 131 receives a backlight local control signal (Local Dimming SPI (Serial Peripheral Interface) signal) from the FPGA/SOC/TCON 12, and the backlight local control signal is used in an "AND" operation (controlling whether the "AND" operation is performed according to an enable signal (BL_EN)) with a brightness modulation signal (DIM_PWM) from the TCON 11 to obtain brightness control signals of the respective backlight blocks. Then, the MCU 131 outputs the brightness control signals to the LED integrated circuit driving chip 132 to implement current control of the LEDs of the respective backlight blocks, thereby controlling the light-emitting brightness of the respective backlight blocks. For example, the TCON 12 and the TCON 11 may be the same TCON. For example, both the backlight local control signal and the brightness modulation signal may be implemented by the TCON 11, and the embodiments of the present disclosure are not limited thereto.

For example, the system of performing the local dimming process is powered by an external DC power source 10, and the supply voltage Vin of the power source 10 is typically 24 voltages (V). For example, the DC/DC circuit 133 can employ a voltage conversion circuit (e.g., a Boost circuit) to boost the supply voltage Vin to a driving voltage required by illuminating the LEDs of the respective backlight blocks.

Because even a small fluctuation of a working voltage applied to the LEDs may cause a large change of the current flowing though the LEDs, the LEDs in the system can be dimmed by a constant-current control mode. To achieve the constant-current control, cathode electrodes (LED−) of the plurality of LEDs connected in series in each of the plurality of backlight blocks are connected to the current sampling circuit 134 to monitor the stability of the currents flowing though LEDs that are driven in real time. The current sampling circuit 134 converts the currents flowing through the LEDs into voltage signals and feeds the voltage signals back to the LED integrated circuit driving chip 132, and then the LED integrated circuit driving chip 132 feeds the voltage signals back to the DC/DC circuit 133. After receiving the voltage signals, the DC/DC circuit 133 adjusts output voltages input to anode electrodes (LED+) of the LEDs to achieve a steady current effect on the LEDs. For example, the converted voltage signals are sampled and the sampled voltage signals are compared to a preset reference voltage. In the case where the sampled voltage signals are higher than the preset reference voltage, the current sampling circuit 134 outputs a control signal to enable the DC/DC circuit 133 to reduce the output voltage, thereby reducing the currents flowing through the LEDs; otherwise, the current sampling circuit 134 outputs another control signal to enable the DC/DC circuit 133 to boost the output voltage to increase the currents flowing through the LEDs. That is, the current sampling circuit 134 can be used as a negative feedback circuit to achieve the constant-current control to the LEDs to enable the LEDs to work stably.

Each of the exemplary backlight units illustrated in FIGS. 1A and 1B includes a plurality of rectangular backlight regions arranged in an array, the local dimming technology can adjust the brightness and darkness of the corresponding backlight blocks according to gray scales of a screen content displayed on the liquid crystal display panel, for a part with higher brightness (gray scale) of a picture, the brightness of the corresponding backlight blocks is also high; and for a part with a lower brightness of the picture, the brightness of the corresponding backlight blocks is also low, thereby achieving a purpose of reducing backlight power consumption, improving the contrast of the display screen, and enhancing the image quality.

Figure 1C:
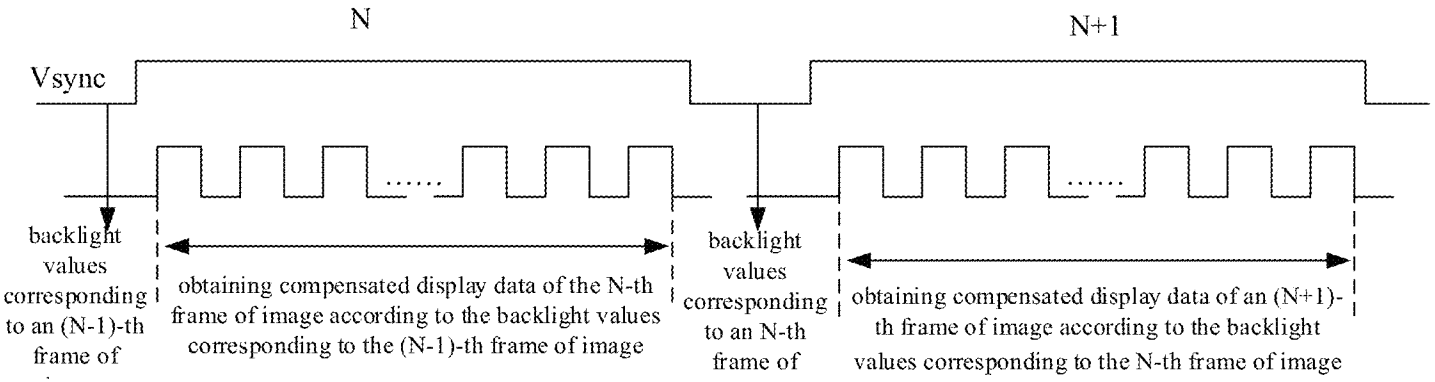
FIG. 1C is a schematic diagram of an image display processing method.

However, the traditional local dimming technology usually uses a frame buffer to store the display data of the current frame of image and to statistics the display data of the current frame of image, to obtain the backlight value corresponding to the current frame of image. For example, as shown in FIG. 1C, after a vertical synchronization signal Vsync is detected, the backlight value obtained from the current frame (for example, an N-th (N is an integer greater than 1) frame as shown in FIG. 1C) of image can only be used to compensate display data of a next frame (for example, an (N+1)-th frame as shown in FIG. 1C) of image, that is, data calculation is performed based on the display data of the next frame of image and the backlight value corresponding to the current frame of image to obtain the compensated display data of the next frame of image. Correspondingly, compensated display data of the current frame of display image is obtained based on the display data (for example, without compensation) of the current frame of image and the backlight value (for example, the backlight value corresponding to an (N−1)-th frame of image) calculated according to display data of a previous frame of image.

Because the compensated display data of the current frame of image is calculated by the backlight value corresponding to the previous frame of image and the display data of the current frame of image, rather than calculated by the backlight value corresponding to the current frame of image and the display data of the current frame of image, the calculation method of the compensated display data of the display image may have a problem of the time delay and mismatching between the backlight information and the image information, and thus is not suitable for applications, such as VR and other application scenarios, which have high delay requirement. Moreover, because the traditional local dimming technology needs to store all display data of one frame of image, the amount of stored data is large and requires to take up a large storage space, and therefore, a large capacity high-speed memory needs to be provided, which increases the cost and is not conducive to product promotion.

At least one embodiment of the present disclosure provides an image display processing method for a display device, the display device includes a backlight unit, the backlight unit includes backlight blocks in L rows and is driven by a local dimming method, and the image display processing method includes: obtaining backlight values of backlight blocks in N rows according to display data of pixels corresponding to the backlight blocks in the N rows in a current frame of image; based on the display data of the pixels corresponding to the backlight blocks in the N rows and the backlight values, which are obtained, of the backlight blocks in the N rows, obtaining compensated display data of the pixels corresponding to the backlight blocks in the N rows in the current frame of image; and N is an integer, is greater than or equal to 1, and is less than L.

At least one embodiment of the present disclosure also provides an image display processing device, a display device, and a storage medium corresponding to the image display processing method described above.

The image display processing method provided by the above embodiments of the present disclosure can save the storage space of the display panel, and can compensate the display data of the current frame of display image based on the backlight values corresponding to the current frame of image, thereby solving the problem of the time delay and mismatching between the backlight information and the image information, improving the contrast of the display image and the display effect of the screen, reducing the power consumption of the display panel, and reducing the cost of the display panel.

The reason that traditional local dimming technology cannot achieve real-time frame calculation is that a calculation time of the backlight data of the entire frame is too long to meet the requirement of the refresh time. However, the present disclosure performs compensation on the display data of the pixels corresponding to the backlight blocks in a current row immediately after calculating the backlight values of the backlight blocks in at least one row, and calculates the backlight values of the backlight blocks in a next row while compensating the display data of the pixels corresponding to the backlight blocks in the current row, so as to only cause a delay in the compensation of the display data corresponding to the backlight blocks in a first row. In a VR system, because it is necessary to wait for the response of the liquid crystal, this delay exists originally, so the delay does not affect the normal use of the VR system, thereby achieving that the backlight values corresponding to the current frame of image are used to compensate the display data of the current frame of display image. So that the problem of the time delay and mismatching between the backlight information and the image information can be solved, and furthermore, the contrast of the display image and the display effect of the screen can be improved, the power consumption of the display panel can be reduced, and the cost of the display panel can be reduced.

The embodiments and examples of the present disclosure will be described in detail below with reference to the drawings.

Figure 2A:
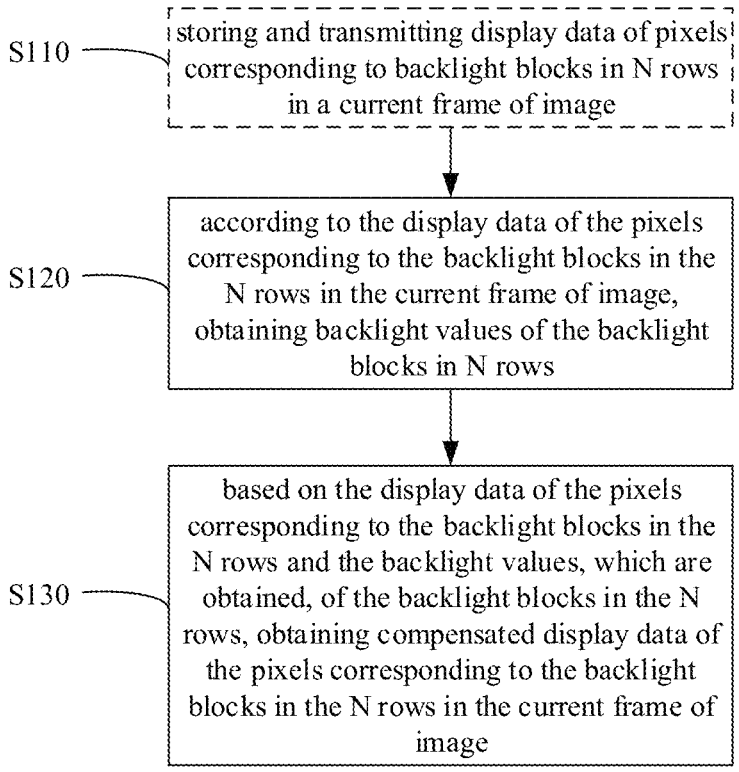
FIG. 2A is a flowchart of an image display processing method provided by some embodiments of the present disclosure.

FIG. 2A is a flowchart of an image display processing method provided by some embodiments of the present disclosure. For example, the display device includes a backlight unit and a display panel, the backlight unit is on a non-display side of the display panel, includes a plurality of backlight blocks, and is driven by a local dimming method. For example, the plurality of backlight blocks of the backlight unit may be disposed in an array arrangement as shown in FIG. 1A, for example, comprising a plurality of rows (such as, at least three rows) and a plurality of columns (such as, at least five columns), the plurality of backlight blocks of the backlight unit may also be disposed in other manners, for example, in an irregular arrangement manner, and the embodiments of the present disclosure are not limited thereto. For example, each backlight block of the backlight unit includes one or more LEDs, such as mini LEDs. For example, a size of the mini LED ranges from 10 μm~100 μm. The mini LED has the advantages of small size, thin thickness, high color gamut, being capable of achieving narrow frame design, and the like. For example, the display device may be a liquid crystal display (LCD) device, an electronic paper display device, or the like, for example, the display device may be a virtual reality device, such as a virtual display helmet or the like. Correspondingly, the display panel of the display device may be a liquid crystal display panel, an electronic paper display panel, or the like, and the embodiments of the present disclosure do not limit the specific structure and type of the display panel (for example, a vertical electric field type of liquid crystal display panel or a horizontal electric field type of liquid crystal display panel).

The image display processing method of some embodiments of the present disclosure may be implemented in a software manner, loaded and executed by a processor in a display panel, for example, loaded and executed by a graphics processing unit (GPU) in the display panel; or at least part of the image display processing method of some embodiments of the present disclosure may be implemented in software, hardware, firmware, or any combination thereof, so as to solve the problem of the time delay and mismatching between the backlight information and the image information and save the storage space of the display panel. For example, the graphics processing unit may be a component inside the display device (for example, an integral form of the VR system), or may be a component of an external device (for example, a computer) of the display device (for example, a split type of the VR system), and the embodiments of the present disclosure are not limited thereto.

For example, the LCD display device may further include a pixel array, a data decoding circuit, a timing controller, a gate driver, a data driver, a storage device (for example, a flash memory or the like), and the like. The data decoding circuit receives a display input signal and decodes the display input signal to obtain a display data signal; and the timing controller outputs timing signals to control the gate driver, the data driver, etc., to work synchronously, and can perform gamma correction on the display data signal. The processed display data signal is input to the data driver to perform a display operation. These components can be implemented in a manner in the art, the embodiments of the present disclosure are not limited thereto, and these components are not described herein again.

Hereinafter, an image display processing method for a display device provided by some embodiments of the present disclosure will be described with reference to FIG. 2A. As shown in FIG. 2A, in an example, the image display processing method includes steps S120 to S130; and in another example, the image display processing method further includes a step S110. The steps S110 to S130 of the image display processing method and respective exemplary implementations of the steps S110 to S130 are respectively described below.

Step S110: storing and transmitting display data of pixels corresponding to backlight blocks in N rows in a current frame of image.

Step S120: according to the display data of the pixels corresponding to the backlight blocks in the N rows in the current frame of image, obtaining backlight values of the backlight blocks in N rows.

Step S130: based on the display data of the pixels corresponding to the backlight blocks in the N rows and the backlight values, which are obtained, of the backlight blocks in the N rows, obtaining compensated display data of the pixels corresponding to the backlight blocks in the N rows in the current frame of image.

Here, the current frame of image corresponds to backlight blocks in L rows, that is, the backlight unit includes the backlight blocks in the L rows, and N is an integer greater than or equal to 1 and less than L.

For example, in some embodiments of the present disclosure, the backlight unit includes backlight blocks located in a plurality of rows, and each row of backlight blocks may correspond to one or more rows of pixels in the current frame of image. For example, in the embodiments of the present disclosure, taking the backlight blocks in every N rows as a period, the above-mentioned image display processing is performed on the display data of the pixels corresponding to the backlight blocks in respective N rows sequentially, so as to obtain all the compensated display data of the current frame of image. For example, in some embodiments of the present disclosure, in the case of calculating the above-mentioned compensated display data of pixels corresponding to the backlight blocks in the N rows, the display data compensation may be performed on the pixels corresponding to the backlight blocks in the N rows based on the backlight values, which are calculated in step 120, of the backlight blocks in the N rows, and the backlight values of the backlight blocks in previous at least one row and in next at least one row adjacent to the N rows may be calculated based on step S120, so that real-time calculation of the compensated display data of the pixels corresponding to the each row of backlight blocks can be achieved.

For example, in some embodiments of the present disclosure, the "pixels corresponding to the backlight blocks in the N rows" refer to the pixels corresponding to the backlight blocks in the N row, for example, can be understood as the pixels on a display panel in an orthographic projection direction of the backlight blocks. For example, the backlight blocks in the N rows may be 1 row, 2 rows, 3 rows, etc., the embodiments of the present disclosure are not limited to this case. For example, during a process of processing the entire frame by taking every N rows as a period, in the case where the number of rows of the remaining backlight blocks is less than N, the remaining backlight blocks can be used as a period to calculate the backlight value and compensate the display data.

Figure 2B:
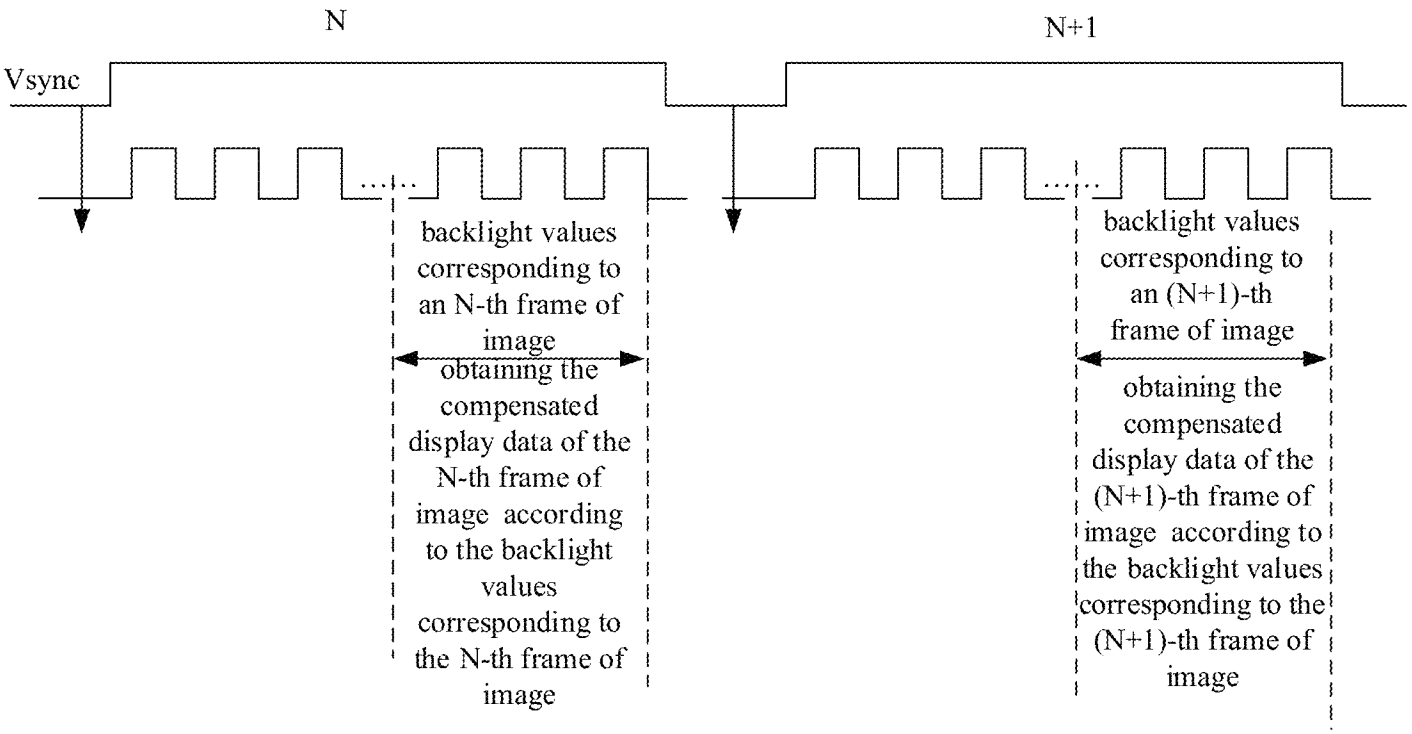
FIG. 2B is a flowchart of an image display processing method provided by some embodiments of the present disclosure.

For example, as shown in FIG. 2B, compared with the image display processing method in FIG. 1C, the image display processing method provided by some embodiments of the present disclosure can obtain the compensated display data of the current frame of image based on the backlight values corresponding to the current frame of image. For example, the compensated display data of an N-th frame of image may be obtained based on the backlight values corresponding to the N-th frame of image, the compensated display data of an (N+1)-th frame of image may be obtained based on the backlight values corresponding to the (N+1)-th frame of image, and so on.

For step S110, for example, because the display data of the pixels corresponding to the backlight blocks in the N rows are used twice during a process of calculating the corresponding backlight values and compensating the corresponding display pixels. Therefore, first, it is necessary to obtain (e.g., store, transmit) the display data corresponding to the part of backlight blocks in the current frame of image.

For example, in some embodiments of the present disclosure, before obtaining the backlight values of the backlight blocks in the N rows, the display data of the pixels corresponding to the backlight blocks in the N rows in the current frame of image are written to a storage unit to obtain two copies of these display data (including the written display data itself). For example, a copy of the display data is transmitted to a display driving chip, and then is temporarily stored in a register. For example, the display data in the register is written into the storage unit. In this case, there is one copy of the display data in the register and one copy of the display data in the storage unit, thereby including two copies of the display data. After that, the local dimming unit (Local Dimming IP) calls the display data in the register to obtain the backlight values of the backlight blocks in the N rows; and another copy of the display data is stored in the storage unit for subsequent use, for example, in a subsequent process, the display data in the storage unit may be read by the local dimming unit to obtain the compensated display data of the pixels corresponding to the backlight blocks in the N rows in the current frame of image. For example, the register is used to buffer data stream in the display driving chip. For example, the storage unit may be a part of the storage units in the display device, that is, a RAM (random access memory) having a certain size in the display device, for example, the part of the storage units is also used to store display data in applications. For example, the part of the storage units can store the data of the entire frame. For example, the storage unit may be another set of registers.

In some embodiments of the present disclosure, the storage unit at least stores the display data of the pixels corresponding to the backlight blocks in the N rows. For example, in the case where the display data of the pixels corresponding to the backlight blocks in the N rows enters the local dimming unit to be used to calculate the backlight values of the backlight blocks in the N rows, the storage unit stores the display data of pixels corresponding to the backlight blocks in the N rows. In the case where the local dimming unit compensates the display data of the pixels in the backlight blocks in the N rows, after the display data, which is stored in the storage unit, corresponding to the pixels in the backlight blocks in the N rows is read, the subsequent display data sequentially enters into the storage unit to be stored, and overwrites the read display data. The specific process can refer to the working process of a storage device in the art, and is not repeated here again.

The display data corresponding to the pixels of the backlight blocks in the N rows are called from the storage unit for compensation calculation and will not be used again. The subsequent display data can overwrite the previous data. Therefore, the storage unit only needs to at least store the display data of the pixels corresponding to the backlight blocks in the N rows, so as to meet the demand.

In some embodiments of the present disclosure, by combining the part of the storage units with the local dimming unit that obtains the backlight values, the corresponding backlight values can be obtained according to the display data of the current frame of image, and the compensated display data of the current frame of image can be obtained based on the backlight values corresponding to the display data of the current frame of image and the display data of the current frame of image. In addition, while compensating the display data of the pixels corresponding to the backlight blocks in the current N rows, the backlight values of the backlight blocks in the next N rows can be calculated, and the backlight values corresponding to the display data of the previous frame of image is avoided being used, so as to solve the problem of the time delay and mismatching of the backlight information and the image information.

At the same time, because the storage unit is a part of the storage units in the display panel, only the display data of the pixels corresponding to the backlight blocks in at least N rows in the current frame of image is stored, thereby saving the storage space of the display panel, reducing the power consumption of the display panel, and reducing the cost of the display panel.

For example, a storage unit and a transmission unit may be provided, and the display data of the pixels corresponding to the backlight blocks in at least N rows in the current frame of image may be stored through the storage unit and transmitted through the transmission unit, respectively; for example, the transmission unit may be a wired transmission unit or a wireless transmission unit. The wired transmission unit may be an electrical signal transmission device or an optical signal transmission device. The electrical signal transmission device transmits data through, for example, a coaxial cable, and the optical signal transmission device transmits data through, for example, an optical fiber. The electrical signal transmission device and the optical signal transmission device are respectively based on related data transmission standards, such as synchronous digital hierarchy (SDH), dense wavelength division multiplexing (DWDM), and the like. The wireless transmission unit can be based on various standard wireless communication devices, such as WIFI, Bluetooth, ZigBee, infrared, 2G/3G/4G/5G mobile communication, and so on. For example, the storage unit and the transmission unit may include a central processing unit (CPU), an image processor (GPU), a tensor processor (TPU), a field programmable logic gate array (FPGA), or other forms of processing units having data processing capabilities and/or instruction execution capabilities and corresponding computer instructions.

For step S120, for example, after the display data of the pixels corresponding to the backlight blocks in the N rows is transmitted to the local dimming unit, the local dimming unit obtains the backlight values of the backlight blocks in the N rows based on the transmitted display data of the pixels corresponding to the backlight blocks in the N rows.

Figure 4:
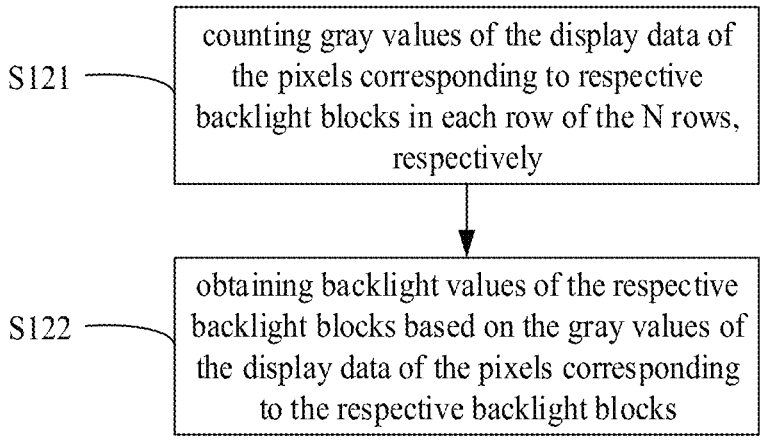
FIG. 4 is a flowchart of an example of obtaining backlight values provided by some embodiments of the present disclosure.

FIG. 4 is a flowchart of an example of obtaining backlight values provided by some embodiments of the present disclosure. That is, FIG. 4 is a flowchart of an example of step S120 as shown in FIG. 2A. For example, in the example as shown in FIG. 4, the method for obtaining the backlight values includes steps S121 to S122. Hereinafter, the image display processing method according to an embodiment of the present disclosure will be described with reference to FIG. 4.

Step S121: counting gray values of the display data of the pixels corresponding to respective backlight blocks in each row of the N rows, respectively.

For example, the gray values of the display data of the pixels corresponding to the respective backlight blocks in each row of two rows of backlight blocks are respectively counted.

For example, the gray values of the display data of the pixels corresponding to the respective backlight blocks in each row of the two rows of backlight block can be separately counted by the histogram, respectively. It should be noted that, the gray values of the display data of the pixels corresponding to the respective backlight blocks in each row can also be counted by other statistical methods in the art, the embodiments of the present disclosure are not limited to this case.

For example, the histogram statistics are used to determine a backlight value of a backlight block, and the deviation data, such as a smaller number of higher gray values or lower gray values, can be filtered, so that the data for calculating the gray value are more accurate, so that the display brightness of the display panel is closer to the target brightness.

Step S122: obtaining backlight values of the respective backlight blocks based on the gray values of the display data of the pixels corresponding to the respective backlight blocks.

For example, a gray value at a position in a range of 80% to 90% of the counted gray values, which are sorted in an order from small to large, of the display data of the pixels corresponding to each backlight block is set as the backlight value of the corresponding backlight block, or an average value of the gray values of the display data of the pixels corresponding to each backlight blocks is set as the backlight value of the corresponding backlight block. For example, if the display data of the pixels corresponding to a backlight block has 100 copies of data remaining after filtering out the deviation data, a gray value at 90% of the display data of the pixels corresponding to the backlight block is taken as the backlight value of the backlight block, that is, after sorting the remaining display data from small to large, a ninetieth display data of the 100 display data is taken as the backlight value of the backlight block.

It should be noted that the backlight values of respective backlight blocks can also be determined according to other methods in the art, and the embodiments of the present disclosure are not limited thereto.

For step S130, for example, based on the display data, which are stored in step S110, of the pixels corresponding to the backlight blocks in the N rows and the backlight values, which are obtained in step S120, of the backlight blocks in the N rows, the compensated display data of the pixels corresponding to the backlight blocks in the N rows in the current frame of image is obtained. For example, the compensated display data is the compensated display data of the respective pixels in each backlight block.

Figure 5:
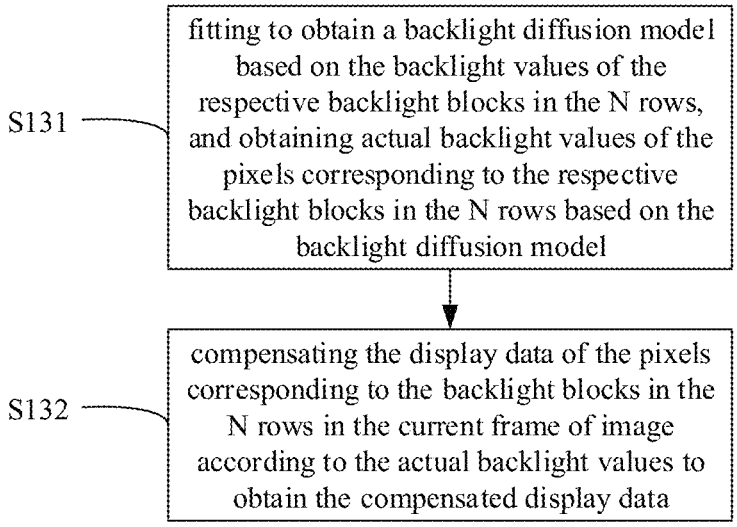
FIG. 5 is a flowchart of an example of obtaining compensated display data provided by some embodiments of the present disclosure.

FIG. 5 is a flowchart of an example of obtaining compensated display data provided by some embodiments of the present disclosure. That is, FIG. 5 is a flowchart of an example of step S130 as shown in FIG. 2A. For example, in the example as shown in FIG. 5, the method for obtaining the compensated display data includes steps S131 to S132. Hereinafter, the image display processing method according to an embodiment of the present disclosure will be described with reference to FIG. 5.

Step 131: fitting to obtain a backlight diffusion model based on the backlight values of the respective backlight blocks in the N rows, and obtaining actual backlight values of the pixels corresponding to the respective backlight blocks in the N rows based on the backlight diffusion model.

For example, the backlight diffusion model is fitted based on the backlight values of the respective backlight blocks in N the rows and the backlight values of backlight blocks in previous at least one row (for example, previous two rows) adjacent to the backlight blocks of the N rows and in next at least one row (for example, next two rows) adjacent to the backlight blocks of the N rows, and the actual backlight values of the pixels corresponding to the respective backlight blocks in the N rows are obtained based on the backlight diffusion model.

For example, a case that an actual backlight value of a certain pixel in an area of the display panel corresponding to a backlight block is taken as an example to describe. Because light emitted by respective LEDs in the backlight unit may generate light diffusion and other phenomena, and therefore, the brightness (that is, the backlight value) of the backlight emitted by the LEDs in different positions in the backlight unit has an effect on the actual backlight brightness at the position where the pixel is located. For example, the closer the distance between the pixel and one LED, the greater the effect of the brightness of the light emitted by the LED on the actual backlight brightness at the position where the pixel is located, therefore, the combination of the brightness of LEDs, which are located at different distances to the pixel, in the backlight unit at the position where the pixel is located requires to be integrated, so as to obtain the actual backlight brightness at the position where the pixel is located. So, the backlight diffusion models of these LEDs at the position where the pixel is located needs to be fitted according to the distances of respective LEDs in each backlight block to the pixel, and according to these backlight diffusion models, the actual backlight brightness of the pixel is calculated, thereby obtaining the actual backlight brightness of each pixel corresponding to each backlight block.

For example, the backlight diffusion models can be actually measured according to methods in the art, and will not be described herein again.

For example, in an example, the backlight diffusion model can be expressed as:

$$psf(x) = \begin{cases} \sum_{i=0}^{n} a_i x^i & 0 \le x \le d_1 \\ \sum_{i=0}^{n} b_i x^i & d_1 \le x \le d_2 \\ 0 & x > d_2 \end{cases},$$

where n is a maximum value of the polynomial fitting, i is an integer greater than or equal to 0 and less than or equal to n, and ai/bi is a corresponding order coefficient of different copy-wise functions, x is a pixel distance from a pixel to a center of a specific area, d1 is a pixel distance of the copy-wise function, d2 is a furthest extended pixel distance of valid data, and psf (x) represents the actual backlight brightness corresponding to each pixel.

It should be noted that the backlight diffusion model is not limited to the above formula expression and is determined according to the actual fitting situation, and the embodiments of the present disclosure are not limited thereto.

For example, in the embodiments of the present disclosure, the case where the backlight blocks in the N rows correspond to an inside position of the current frame of image (that is, the backlight blocks in the N rows do not include the backlight blocks in an outermost row), the actual backlight values of the pixels corresponding to the backlight blocks in the N rows can be obtained based on the backlight diffusion model and combined with the backlight values of the backlight blocks in a previous row adjacent to the backlight blocks of the N rows, the backlight values of the backlight blocks in a next row adjacent to the backlight blocks of the N rows, and the backlight values of the backlight blocks in the N rows.

For example, in the case where the backlight blocks in the N rows includes the backlight blocks in two rows, if a current row of the backlight blocks is not a first row of the backlight blocks, because the related data (for example, backlight value) of the backlight blocks in a previous row adjacent to the current row has been obtained in the previous calculation, and therefore, in the subsequent calculations, the related data of the backlight blocks in the previous row adjacent to the current row can be directly taken into account, it only needs to wait for achieving the calculation of the related data (for example, backlight value) of the backlight blocks in a next row adjacent to the current row, and then the actual backlight values of the backlight blocks in the current row are calculated. If the current row of the backlight blocks is the first row of the backlight blocks, the actual backlight values of the backlight blocks in the current row may be calculated only based on the backlight values of the backlight blocks in the first row and the backlight blocks in a second row. For example, the backlight values of the backlight blocks in the first row can be copied as the backlight values of the backlight blocks in the previous row adjacent to the first row, and the backlight values of the backlight blocks in the previous row are combined with the backlight values of the backlight blocks in the first row and the second row to calculate the actual backlight values of the backlight blocks in the first row. For example, the actual backlight values of the backlight blocks in the current row can be calculated based on the backlight blocks in the previous one or more rows adjacent to the current row and/or the backlight blocks in the next one or more rows adjacent to the current row, and the backlight blocks in the current row, and the embodiments of the present disclosure are not limited thereto.

Because one backlight block corresponds to display data of pixels in a plurality of rows and a plurality of columns, the storage space required for the backlight values of the backlight blocks in one row is much smaller than the storage space for the display data of the corresponding pixels, so that the backlight values of the backlight blocks in each row can be stored as needed without requiring a large amount of storage space. For example, in the process of compensating the display data, the backlight values may be used multiple times, so all backlight values can be stored. In another embodiment, the backlight values may be deleted after being used multiple times. For example, according to the backlight model, the actual backlight values of the backlight blocks in a certain row needs to be calculated based on the backlight values of the backlight blocks in a previous row adjacent to the certain row and the backlight values of the backlight blocks in a next row adjacent to the certain row, so the backlight values of the backlight blocks in the certain row are used in order to calculate the actual backlight values of the previous row, the actual backlight values of the certain row, and the actual backlight values of the next row. After the actual backlight values in the next row is calculated, the data of the backlight values in the certain row can be overwritten by the data of the subsequent calculated backlight values, that is, the data of the backlight values in the certain row can be deleted. The specific process can refer to the working process of the storage device in the art, and is not repeated here again.

Step S132: compensating the display data of the pixels corresponding to the backlight blocks in the N rows in the current frame of image according to the actual backlight values to obtain the compensated display data.

Because the display brightness (luminous intensity) of each pixel in a liquid crystal display panel at a certain time is not only related to the actual backlight value at the certain time, but also to the display data of the pixel, after the actual backlight values of respective pixels in the backlight block are obtained according to the backlight diffusion model, it may be necessary to perform display compensation on the display data of the pixels, so that the display panel achieves the desired display brightness.

For example, the compensated display data of the pixels can be obtained according to the following formula:

$$Vc = V0 * (BL_M / BL_P),$$

where Vc represents the compensated display data of a pixel among all pixels corresponding to the backlight blocks in the N rows, V0 represents the display data of the pixel before compensation, BL_M represents the backlight value corresponding to the pixel at a highest gray level, and BL_P represents the actual backlight value corresponding to the pixel.

It should be noted that the highest gray level may be 255, 1023, etc. The specific setting may be determined according to the actual situation, the embodiments of the present disclosure are not limited to this case.

In some embodiments of the present disclosure, because the compensation of the display data of the pixels corresponding to the backlight blocks in the N rows needs to be calculated based on the backlight values of the backlight blocks in previous at least one row adjacent to the backlight blocks in the N rows and the backlight blocks in next at least one row adjacent to the backlight blocks in the N rows, the storage unit needs to at least store the display data of the pixels corresponding to the backlight blocks in the (N+1) rows, that is, for the compensation of the display data of the pixels corresponding to the backlight blocks in the N rows, it is necessary to wait for storing the display data of the pixels corresponding to the backlight blocks in a next row in the storage unit and calculating the backlight values of the row, and then the compensation for the display data of the pixels corresponding to the backlight blocks in the N rows are performed.

The image display processing method provided by the above embodiments of the present disclosure can save the storage space of the display panel, and can compensate the display data of the current frame of display image based on the backlight values corresponding to the current frame of image, thereby solving the problem of the time delay and mismatching between the backlight information and the image information, improving the contrast of the display image and the display effect of the screen, reducing the power consumption of the display panel, and reducing the cost of the display panel.

Figure 6:
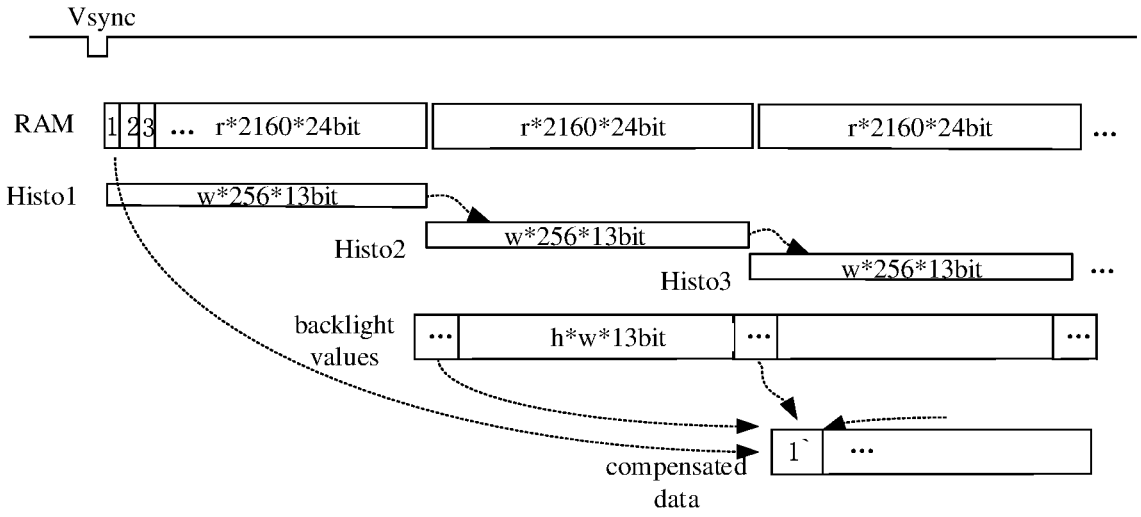
FIG. 6 is a schematic diagram of a specific example of an image display processing method provided by some embodiments of the present disclosure.

FIG. 6 is a schematic diagram of a specific example of an image display processing method provided by some embodiments of the present disclosure, and in this embodiment, N=1. As shown in FIG. 6, r represents a number of rows of the pixels corresponding to one backlight block, 2160 represents a number of columns of the pixels of the display panel, and 24 bit represents a number of bits the display data included in each pixel (the number of bits of the display data is 24 bit). When a vertical synchronization signal Vsync is activated, the display data of the pixels corresponding to the backlight blocks in each row in the current frame of image, for example, 1, 2, 3, . . . , sequentially enters into, for example, a local dimming unit with one row as a period, the histogram statistics of the display data of the pixels corresponding to the backlight blocks in respective rows are sequentially obtained, and the r rows of display data are written into the RAM and stored. For example, the distribution of the 256 gray scales of the display data of the pixels corresponding to each backlight block is obtained through histogram statistics, h represents a number of rows of the backlight blocks corresponding to the display panel, w represents a number of columns of the backlight blocks corresponding to the display panel, and 13 bit represents a number of pixels that each grayscale histogram can accommodate, that is, the number of pixels in each backlight block is less than or equal to $2^{13}$, w*256*13 bit represents that each Histo includes histogram statistics corresponding to w backlight blocks, and each statistic of the w histogram statistics has 256 gray scales of the display data of the pixels corresponding to the corresponding backlight block and the number of pixels corresponding to each gray scale, for example, each gray scale of the 256 gray scales corresponds to $2^{13}$ pixels at most (for example, if the gray scales of all pixels on a backlight block are the same, the number of pixels corresponding to the gray scale is $2^{13}$), and therefore, the number of gray scales of the pixels corresponding to each backlight block can be calculated through the histogram, so that the backlight value of the corresponding backlight block can be determined according to the number of pixels corresponding to each gray scale in the histogram corresponding to each backlight block (referring to step S122). Histo1 represents (or includes) w histogram statistics that are in one-to-one correspondence with w backlight blocks in the first row, and Histo2 represents (or includes) w histograms statistics that in one-to-one correspondence with the w backlight blocks in the second row, Histo3 represents (or includes) w histogram statistics that are in one-to-one correspondence with the w backlight blocks in a third row, . . . . After the display data of the pixels corresponding to the respective backlight blocks in a row are respectively counted, the backlight values of the pixels corresponding to the backlight blocks in the row can be obtained (for example, obtained in step S120).

As shown in FIG. 6, while performing histogram statistics in the local dimming unit, another copy of the display data is stored in a part of the storage unit RAM. After obtaining the backlight values of the backlight blocks in first two rows according to the above method, at this time, the storage data in the RAM includes display data of pixels corresponding to the backlight blocks in two rows (the first row and second row); the display data, which is stored in a part of the storage units, of the pixels corresponding to the backlight blocks in the first row is read and is calculated with the obtained actual backlight value (for example, the actual backlight value obtained based on the backlight diffusion model formed according to the backlight blocks in the first two rows), so as to obtain the compensated display data, for example, 1', of the respective pixels corresponding to the backlight blocks in the first row in the current frame of image of the display panel. At the same time, the display data of the pixels corresponding to the backlight blocks in the third row is written into the RAM (overwriting the first row of data), and the calculation of the backlight values of the backlight blocks in the third row is completed, in this case, the data stored in the RAM still only includes the display data of the pixels corresponding to the backlight blocks in two rows (the second row and the third row); after that, the display data, which is stored in the part of the storage units, of the pixels corresponding to the backlight blocks in the second row can be read and calculated with the actual backlight values (for example, the actual backlight values obtained based on the backlight diffusion model formed according to the backlight blocks in the first three rows), so as to obtain the compensated display data, such as 2', of the respective pixels corresponding to the backlight blocks in the second row in the current frame of image of the display panel. At the same time, the display data of the pixels corresponding to the backlight blocks in a fourth row is written into the RAM (overwriting the data of the second row), and in this case, the data stored in the RAM still only includes the display data of the pixels corresponding to the backlight blocks in two rows (the third row and the fourth row), . . . . In the whole process, RAM only stores the display data of the pixels corresponding to the backlight blocks in two rows, and real-time compensation of the current frame display data is achieved. It should be noted that each data as shown in FIG. 6 may be specifically set according to an actual situation, and the embodiments of the present disclosure are not limited thereto.

Figure 3:
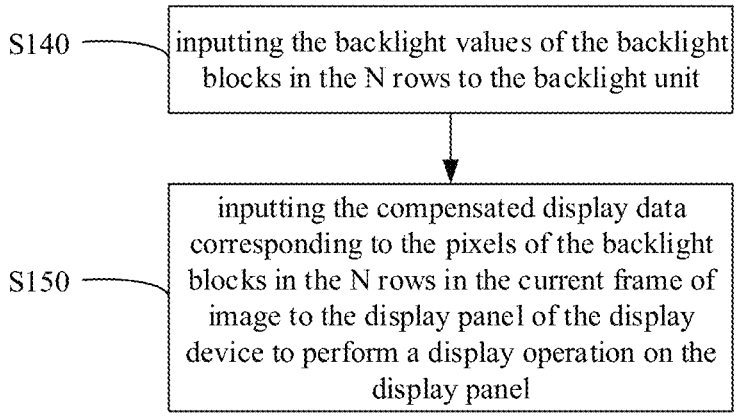
FIG. 3 is a flowchart of another image display processing method provided by some embodiments of the present disclosure.

FIG. 3 is a flowchart of another image display processing method provided by some embodiments of the present disclosure. As shown in FIG. 3, based on the example as shown in FIG. 2A, the image display processing method further includes steps S140 and S150. The steps S140 and S150 are described in detail below.

Step S140: inputting the backlight values of the backlight blocks in the N rows to the backlight unit.

For example, the backlight values of the backlight blocks in the N rows are input to the LED driving circuit board 13. The LED driving circuit board 13 generates driving currents for the respective backlight blocks based on the backlight values of the respective backlight blocks, and outputs the driving currents to the corresponding backlight blocks to control the LEDs in these backlight blocks to emit light through the driving currents.

Step S150: inputting the compensated display data corresponding to the pixels of the backlight blocks in the N rows in the current frame of image to the display panel of the display device to perform a display operation on the display panel.

For example, the compensated display data is transmitted to a data driver of the display panel, and is transmitted to a corresponding pixel of the display panel through the data driver. The pixels in the display panel are turned on line by line under the driving of the gate scan signals to control the deflection of the liquid crystal molecules of the liquid crystal layer in the corresponding pixels in the display panel according to the compensated display data transmitted by the data driver, so that the light emitted by the backlight unit is transmitted, and a display image is displayed on the display panel.

For example, a local dimming unit for obtaining the backlight values and the compensated display data may be provided, and the compensated display data of the pixels corresponding to the backlight blocks in the N rows is obtained through the local dimming unit; for example, the local dimming unit can also be implemented by a central processing unit (CPU), a field-programmable gate array (FPGA), or other forms of processing unit having data processing capabilities and/or program execution capabilities, and corresponding computer instructions. For example, the processing unit may be a general-purpose processor or a special-purpose processor, and may be a processor based on the X86 or ARM architecture.

It should be noted that, the flowchart of the image display processing method provided by some embodiments of the present disclosure may include more or less operations, and the operations may be performed sequentially or in parallel. Although the flowchart of the image display processing method described above includes a plurality of operations occurring in a specific order, it should be clearly understood that, the order of the plurality of operations is not limited. The image display processing method described above may be performed once or may be performed a plurality of times according to predetermined conditions.

Figure 7:
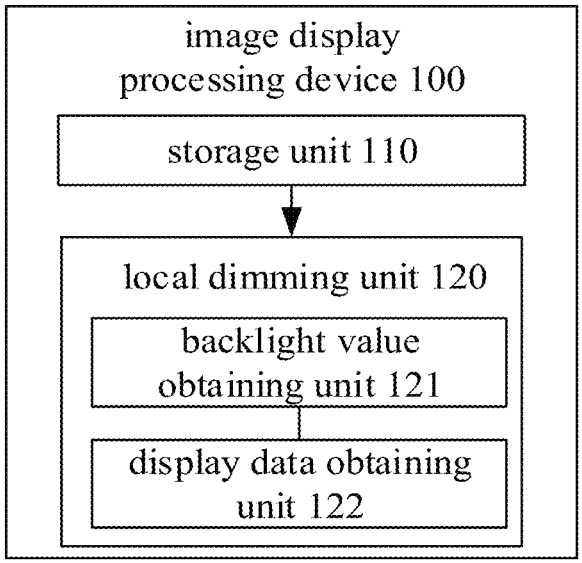
FIG. 7 is a schematic block diagram of an image display processing device provided by some embodiments of the present disclosure.

FIG. 7 is a schematic block diagram of an image display processing device provided by some embodiments of the present disclosure. For example, in an example, the image display processing device 100 includes a storage unit 110 and a local dimming unit 120. For example, these units may be implemented in the form of hardware (for example, circuit) modules or software modules and any combination thereof.

The storage unit 110 is configured to store display data of pixels corresponding to backlight blocks in N rows in a current frame of image. For example, the storage unit 110 may implement step S110, for a specific implementation method, reference may be made to the related description of step S110, and details are not described herein again. For example, after the display data stored in the storage unit 110 is used to calculate the backlight values of the backlight blocks in the corresponding row and the compensated display data of the pixels corresponding to the backlight blocks in the corresponding row, the display data in the corresponding row is overwritten by the display data of the pixels corresponding to the backlight blocks in the next row, that is, the originally stored display data will be deleted.

The local dimming unit 120 is configured to receive the display data, which is transmitted, of the pixels corresponding to the backlight blocks in the N rows in the current frame of image; obtain backlight values of the backlight blocks in the N rows according to the display data, which is transmitted, of the pixels corresponding to the backlight blocks in the N rows in the current frame of image; and based on the display data, which is stored, of the pixels corresponding to the backlight blocks in the N rows and the backlight values, which are obtained, of the backlight blocks in the N rows, obtain compensated display data of the pixels corresponding to the backlight blocks in the N rows in the current frame of image. For example, the local dimming unit 120 may implement steps S120 and S130. For a specific implementation method, reference may be made to related descriptions of steps S120 and S130, and details are not described herein again.

For example, in another example, the local dimming unit 120 may include a backlight value obtaining unit 121 and a display data obtaining unit 122.

For example, the backlight value obtaining unit 121 is configured to obtain the backlight values of the backlight blocks in the N rows according to the display data, which is transmitted, of the pixels corresponding to the backlight blocks in the N rows. For example, the backlight value obtaining unit 121 may implement step S120. For a specific implementation method, reference may be made to the related description of step S120, and details are not described herein again.

For example, the display data obtaining unit 122 is configured to, based on the display data, which is stored, of the pixels corresponding to the backlight blocks in the N rows and the backlight values, which are obtained, of the backlight blocks in the N rows, obtain the compensated display data of the pixels corresponding to the backlight blocks in the N rows in the current frame of image. For example, the display data obtaining unit 122 may implement step S130. For a specific implementation method, reference may be made to the related description of step S130, and details are not described herein again.

It should be noted that, the image display processing device provided by the embodiments of the present disclosure may include more or fewer circuits or units, and the connection relationship among the respective circuits or units is not limited and may be determined according to actual needs. The specific configuration of each circuit is not limited, and may include an analog device according to the circuit principle, may also include digital chips, or other suitable manners.

Figure 8:
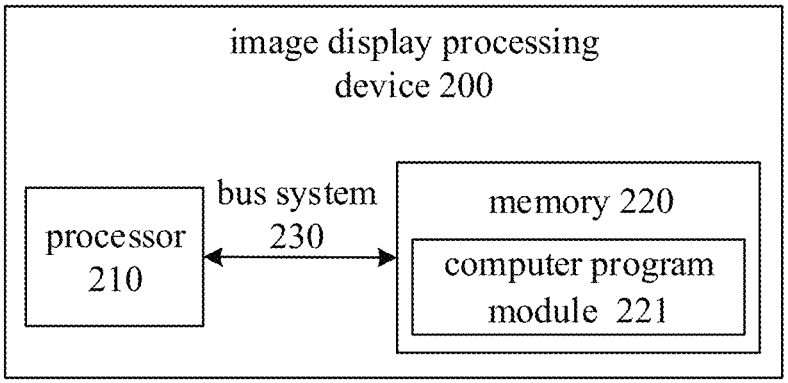
FIG. 8 is a schematic block diagram of another image display processing device provided by some embodiments of the present disclosure.

FIG. 8 is a schematic block diagram of another image display processing device provided by some embodiments of the present disclosure. As shown in FIG. 8, the image display processing device 200 includes a processor 210, a memory 220, and one or more computer program modules 221.

For example, the processor 210 is connected with the memory 220 by a bus system 230. For example, the one or more computer program modules 221 are stored in the memory 220. For example, the one or more computer program modules 221 include instructions, which are executable by a computer, used for achieving the image display processing method provided by any one of the embodiments of the present disclosure. For example, the instructions of the one or more computer program modules 221 can be executed by the processor 210. For example, the bus system 230 is a commonly used serial or parallel communication bus, etc., and the embodiments of the present disclosure are not limited in this aspect.

For example, the processor 210 may be a central processing unit (CPU), a field programmable logic gate array (FPGA), or other processing units with a data processing ability and/or instruction execution ability. For example, the processor 210 may be a general processor or a dedicated processor, and can control other components in the image display processing device 200 to achieve the expected functions.

The memory 220 can include one or more computer program products, and the computer program products includes a computer-readable storage media in various forms, for example, includes a volatile storage and/or a non-volatile storage. The volatile storage, for example, includes a random access memory (RAM) and/or a cache memory, etc. The non-volatile storage, for example, includes a read-only memory (ROM), a hard disk, and a flash memory, etc. One or more computer program instructions can be stored in the computer-readable storage medium, and the processor 210 can run or execute the program instructions to achieve the functions (which are to be achieved by the processor 210) in the embodiments of the present disclosure and/or other expected functions, such as an image display processing method, etc. Various applications and data, such as the backlight values of the backlight blocks in the N rows and various data used and/or generated by application programs, etc., can also be stored in the computer-readable storage medium.

It should be noted that in order to be clear and concise, the embodiment of the present disclosure does not illustrate all components of the image display processing device 200. Those skilled in the art can provide and set other components, which are not illustrated in the figures, of the image display processing device 200 according to actual requirements to achieve necessary functions of the image display processing device 200, and the embodiment of the present disclosure is not limited thereto.

Technical effects of the image display processing device 100 and the image display processing device 200 in different embodiments can refer to the technical effects of the image display processing method provided by at least one embodiment of the present disclosure, and details are not described here again.

Figure 9:
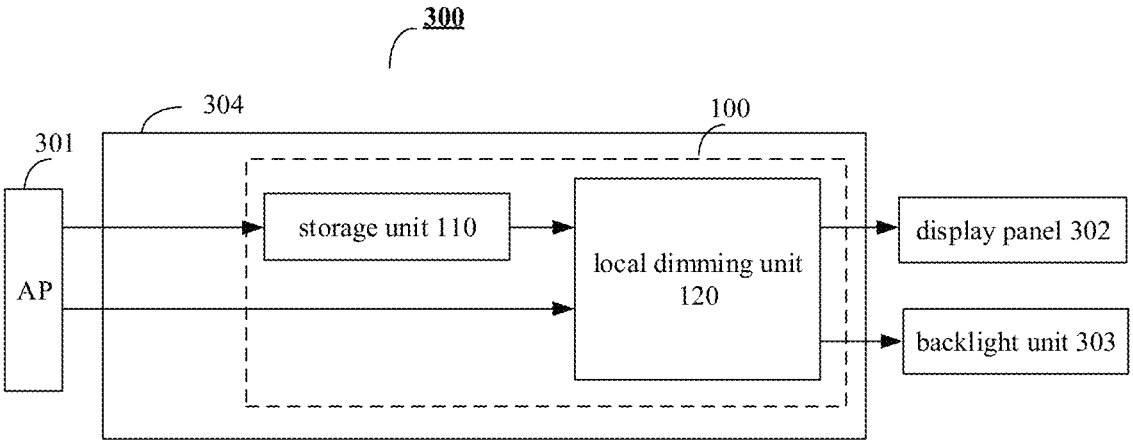
FIG. 9 is a schematic block diagram of a display device provided by some embodiments of the present disclosure.

At least one embodiment of the present disclosure also provides a display device, the display device includes a display panel, a backlight unit, and an image display processing device provided by any one embodiment of the present disclosure. FIG. 9 is a schematic block diagram of a display device provided by some embodiments of the present disclosure. As shown in FIG. 9, a display device 300 includes an AP (Application Processor) 301, a display driving chip 304, a display panel 302, a backlight unit 303, and an image display processing device 100 provided by any embodiment of the present disclosure.

For example, the backlight unit 303 includes a plurality of backlight blocks and is driven by a local dimming method.

For example, the image display processing device 300 may be the image display processing device 100 as shown in FIG. 7, and includes a storage unit 110 and a local dimming unit 120.

For example, the storage unit 110 is configured to store display data of pixels corresponding to backlight blocks in N rows in a current frame of image. For example, the storage unit is configured to store display data of pixels corresponding to the backlight blocks in at least N rows, for example, after obtaining the compensated display data of pixels corresponding to the backlight blocks in the N rows in the current frame of image, the stored display data is deleted.

The local dimming unit 120 is configured to receive the display data, which is transmitted, of the pixels corresponding to the backlight blocks in the N rows in the current frame of image; obtain backlight values of the backlight blocks in the N rows according to the display data, which is transmitted, of the pixels corresponding to the backlight blocks in the N rows in the current frame of image; and based on the display data, which is stored, of the pixels corresponding to the backlight blocks in the N rows and the backlight values, which are obtained, of the backlight blocks in the N rows, obtain compensated display data of the pixels corresponding to the backlight blocks in the N rows in the current frame of image.

For example, after the display data of the current frame of image is transmitted from the AP 301 to the display driving chip 304, a copy of the display data of the display data of the pixels corresponding to the backlight blocks in the N rows in the current frame of image is transmitted to the local dimming unit 120 for backlight statistics to obtain the backlight values, and the other copy of display data is stored in the storage unit 110. After obtaining the backlight values, the local dimming unit 120 obtains the stored display data from the storage unit 110, and calculates the backlight value and the display data of the corresponding pixels to obtain the compensated display data of the corresponding display data.

For example, the backlight values are transmitted to the LED driving circuit board in the backlight unit 303, so as to control the LEDs in the corresponding backlight block included in the backlight unit 303 to emit light; at the same time, the compensated display data is, for example, sent to a driving chip (not shown in the figure, for example, a data driver) in the display panel 302 to control the deflection of the liquid crystal molecules of the liquid crystal layer of the corresponding pixel in the display panel, so that the light emitted from the backlight unit 303 is transmitted, and a display image is displayed on the display panel 302.

For example, the display device 100 may be a thin film transistor liquid crystal display device, an electronic paper display device, or the like. For example, the display device is a VR device, such as a VR helmet or the like, and the embodiments of the present disclosure are not limited to this case.

For example, these components are interconnected by a bus system and/or other coupling mechanisms (not shown in figures). For example, the bus system may be a serial, parallel communication bus, etc., and the embodiments of the present disclosure are not limit to this case. It should be noted that the components and structures of the display device 300 as shown in FIG. 9 are merely exemplary and not limited to this case, and the display device 300 may include other components and structures as needed.

Technical effects of the display device 300 provided by some embodiments of the present disclosure can refer to the corresponding descriptions of the image display processing method in the above embodiments, and details are not described herein again.

Figure 10:
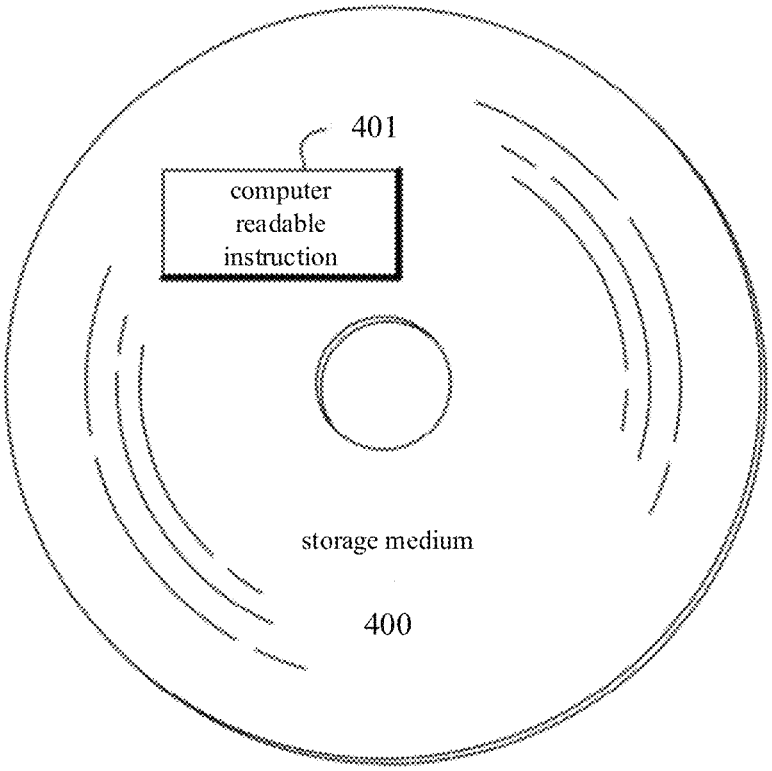
FIG. 10 is a schematic diagram of a storage medium provided by some embodiments of the present disclosure.

Some embodiments of the present disclosure also provide a storage medium. FIG. 10 is a schematic diagram of a storage medium provided by some embodiments of the present disclosure. For example, the storage medium 400 non-temporarily stores computer readable instructions 401, the image display processing method provided by any one of the embodiments of the present disclosure may be performed when the computer readable instructions 401, which are stored non-temporarily, are executed by a computer (comprising a processor).

For example, the storage medium may be any combination of one or more computer-readable storage media. For example, one computer-readable storage medium includes computer-readable program codes used for obtaining the backlight values of the backlight blocks in the N rows, and another computer-readable storage medium includes computer-readable program codes used for obtaining the compensated display data of the pixels corresponding to the backlight blocks in the N rows in the current frame of image. For example, in the case where the program codes are read by the computer, the program codes stored in the computer-readable storage medium are executed by the computer, and for example, the image display processing method provided by any one of the embodiments of the present disclosure is performed.

For example, the non-volatile storage medium may include a memory card of a smart phone, a storage component of a tablet, a hard disk of a personal computer, a random access memory (RAM), a read-only memory (ROM), an erasable programmable read-only memory (EPROM), a portable compact disk read-only memory (CD-ROM), a flash memory, or any combination of the above-mentioned storage media, may also be other suitable storage media.

Technical effects of the storage medium provided by the embodiments of the present disclosure can refer to the corresponding descriptions of the image display processing method in the above embodiments, and details are not described herein again.

The following should be noted:

(1) Only the structures involved in the embodiments of the present disclosure are illustrated in the drawings of the embodiments of the present disclosure, and other structures can refer to usual designs.

(2) In case of no conflict, the embodiments and features in the embodiments of the present disclosure may be combined to obtain new embodiments.

What have been described above merely are exemplary embodiments of the disclosure, and not intended to define the scope of the disclosure, and the scope of the disclosure is determined by the appended claims.

What is claimed is:

1. An image display processing method for a display device, wherein the display device comprises a backlight unit, the backlight unit comprises backlight blocks in L rows and is driven by a local dimming method, and the image display processing method comprises:

obtaining backlight values of backlight blocks in N rows according to display data of pixels corresponding to the backlight blocks in the N rows in a current image frame; and based on the display data of the pixels corresponding to the backlight blocks in the N rows and the backlight values, which are obtained, of the backlight blocks in the N rows, obtaining compensated display data of the pixels corresponding to the backlight blocks in the N rows in the current image frame, wherein N is an integer, and N is greater than or equal to 1 and is less than L, where L is an integer greater than 1;

the image display processing method further comprising:

before obtaining the backlight values of the backlight blocks in the N rows, writing the display data of the pixels corresponding to the backlight blocks in the N rows in the current image frame into a storage unit to obtain two copies of the display data, wherein one copy of the display data is used to obtain the backlight values of the backlight blocks in the N rows, and another copy of the display data is stored and used to obtain the compensation display data of the pixels corresponding to the backlight blocks in the N rows in the current image frame.

2. The image display processing method according to claim 1, further comprising:

by the storage unit, at least storing the display data of the pixels corresponding to the backlight blocks in the N rows.

3. The image display processing method according to claim 2, wherein obtaining the compensated display data of the pixels corresponding to the backlight blocks in the N rows in the current image frame, comprises:

based on the backlight values of the backlight blocks in the N rows and backlight values of backlight blocks in previous at least one row adjacent to the backlight blocks in the N rows and in next at least one row adjacent to the backlight blocks in the N rows, fitting to obtain a backlight diffusion model;

obtaining actual backlight values of the pixels corresponding to the backlight blocks in the N rows based on the backlight diffusion model; and compensating the display data of the pixels corresponding to the backlight blocks in the N rows in the current image frame according to the actual backlight values to obtain the compensated display data of the pixels.

4. The image display processing method according to claim 1, wherein obtaining the compensated display data of the pixels corresponding to the backlight blocks in the N rows in the current image frame, comprises:

based on the backlight values of the backlight blocks in the N rows and backlight values of backlight blocks in previous at least one row adjacent to the backlight blocks in the N rows and in next at least one row adjacent to the backlight blocks in the N rows, fitting to obtain a backlight diffusion model;

obtaining actual backlight values of the pixels corresponding to the backlight blocks in the N rows based on the backlight diffusion model; and compensating the display data of the pixels corresponding to the backlight blocks in the N rows in the current image frame according to the actual backlight values to obtain the compensated display data of the pixels.

5. The image display processing method according to claim 4, wherein the compensated display data of the pixels are obtained according to a following formula:

$$Vc=V0*(BL_M/BL_P),$$

where Vc represents compensated display data of a pixel among all pixels corresponding to the backlight blocks in the N rows, V0 represents display data of the pixel before the pixel is compensated, BL_M represents a backlight value corresponding to the pixel at a highest gray level, and BL_P represents an actual backlight value corresponding to the pixel.

6. The image display processing method according to claim 1, wherein obtaining the backlight values of the backlight blocks in the N rows according to the display data of the pixels corresponding to the backlight blocks in the N rows in the current image frame, comprises:

counting gray values of display data of pixels corresponding to respective backlight blocks in each row of the N rows, respectively; and obtaining backlight values of the respective backlight blocks based on the gray values of the display data of the pixels corresponding to the respective backlight blocks.

7. The image display processing method according to claim 6, wherein the gray values of the display data of the pixels corresponding to the respective backlight blocks in each row of the N rows are counted through a histogram, respectively.

8. The image display processing method according to claim 6, wherein a gray value at a position in a range of 80% to 90% of the gray values, which are counted and sorted in an order from small to large, of the display data of the pixels corresponding to each backlight block is set as the backlight value of the corresponding backlight block, or an average value of the gray values of the display data of the pixels corresponding to each backlight block is set as the backlight value of the corresponding backlight block.

9. The image display processing method according to claim 1, further comprising:

taking every N rows as a period, sequentially obtaining compensated display data of all pixels of the current image frame.

10. The image display processing method according to claim 1, wherein each of the backlight blocks comprises a mini light-emitting diode.

11. The image display processing method according to claim 1, wherein N is equal to 1.

12. An image display processing device, comprising:

a processor; and a memory, storing one or more computer program modules, wherein the one or more computer program modules are configured to be executed by the processor, and the one or more computer program modules comprise instructions for performing the image display processing method according to claim 1.

13. A non-transitory computer readable storage medium, non-temporarily storing computer-readable instructions, wherein in the case where the computer-readable instructions, which are stored non-temporarily, are executed by a computer, the image display processing method according to claim 1 is performed.

14. The image display processing method according to claim 1, wherein the display device further comprises a display panel, the backlight unit is on a non-display side of the display panel, and the image display processing method further comprises:

inputting the backlight values of the backlight blocks in the N rows to the backlight unit; and inputting the compensated display data of the pixels corresponding to the backlight blocks in the N rows in the current image frame to the display panel of the display device to perform a display operation on the display panel.

15. An image display processing device, comprising:

a storage unit, configured to store display data of pixels corresponding to backlight blocks in N rows in a current image frame; and a local dimming unit, configured to receive the display data, which is transmitted, of the pixels corresponding to the backlight blocks in the N rows in the current image frame; obtain backlight values of the backlight blocks in the N rows according to the display data, which is transmitted, of the pixels corresponding to the backlight blocks in the N rows in the current image frame; and based on the display data, which is stored, of the pixels corresponding to the backlight blocks in the N rows and the backlight values, which are obtained, of the backlight blocks in the N rows, obtain compensated display data of the pixels corresponding to the backlight blocks in the N rows in the current image frame, wherein the storage unit is further configured to, before obtaining the backlight values of the backlight blocks in the N rows, receive the display data of the pixels corresponding to the backlight blocks in the N rows in the current image frame into a storage unit to obtain two copies of the display data, wherein one copy of the display data is used to obtain the backlight values of the backlight blocks in the N rows, and another copy of the display data is stored and used to obtain the compensation display data of the pixels corresponding to the backlight blocks in the N rows in the current image frame;

the current image frame corresponds to backlight blocks in L rows, N is an integer, and N is greater than or equal to 1 and is less than L, where L is an integer greater than 1.

16. The image display processing device according to claim 15, wherein the local dimming unit comprises a backlight value obtaining unit and a display data obtaining unit, wherein the backlight value obtaining unit is configured to obtain the backlight values of the backlight blocks in the N rows according to the display data, which is transmitted, of the pixels corresponding to the backlight blocks in the N rows; and the display data obtaining unit is configured to, based on the display data, which is stored, of the pixels corresponding to the backlight blocks in the N rows and the backlight values, which are obtained, of the backlight blocks in the N rows, obtain the compensated display data of the pixels corresponding to the backlight blocks in the N rows in the current image frame.

17. The image display processing device according to claim 15, wherein the storage unit is configured to at least store the display data of the pixels corresponding to the backlight blocks in the N rows.

18. A display device, comprising: a display panel, a backlight unit, a storage unit, and a local dimming unit, wherein the backlight unit comprises backlight blocks in L rows and is driven by a local dimming method;

the storage unit is configured to store display data of pixels corresponding to backlight blocks in N rows in a current image frame; and the local dimming unit is configured to receive the display data, which is transmitted, of the pixels corresponding to the backlight blocks in the N rows in the current image frame; obtain backlight values of the backlight blocks in the N rows according to the display data, which is transmitted, of the pixels corresponding to the backlight blocks in the N rows in the current image frame; and based on the display data, which is stored, of the pixels corresponding to the backlight blocks in the N rows and the backlight values, which are obtained, of the backlight blocks in the N rows, obtain compensated display data of the pixels corresponding to the backlight blocks in the N rows in the current image frame, wherein the storage unit is further configured to, before obtaining the backlight values of the backlight blocks in the N rows, receive the display data of the pixels corresponding to the backlight blocks in the N rows in the current image frame into a storage unit to obtain two copies of the display data, wherein one copy of the display data is used to obtain the backlight values of the backlight blocks in the N rows, and another copy of the display data is stored and used to obtain the compensation display data of the pixels corresponding to the backlight blocks in the N rows in the current image frame;

N is an integer, is greater than or equal to 1, and is less than L, where L is an integer greater than 1.

* * * * *